US008850627B2

(12) United States Patent
Chiang

(10) Patent No.: US 8,850,627 B2
(45) Date of Patent: Oct. 7, 2014

(54) SWIMMING GOGGLES

(75) Inventor: Herman Chiang, New Taipei (TW)

(73) Assignee: Global Esprit Inc., New Taipei (TW)

( * ) Notice: Subject to any disclaimer, the term of this patent is extended or adjusted under 35 U.S.C. 154(b) by 212 days.

(21) Appl. No.: 13/476,286

(22) Filed: May 21, 2012

(65) Prior Publication Data

US 2013/0269088 A1 Oct. 17, 2013

(30) Foreign Application Priority Data

Apr. 12, 2012 (TW) ..... 101206617 U

(51) Int. Cl.
*A61F 9/02* (2006.01)

(52) U.S. Cl.
USPC ..... 2/448; 2/426; 24/170

(58) Field of Classification Search
CPC .. A63B 33/00; A63B 33/02; A63B 2033/004; A63B 71/10; A61F 9/027; A61F 9/025; A61F 9/029; A61F 9/02; A61F 9/026; A42B 3/042; B63C 2011/128; G02C 3/003
USPC ..... 2/426, 431, 440, 442, 445, 446, 448, 2/450, 452; 24/170, 173, 178, 193
See application file for complete search history.

(56) References Cited

U.S. PATENT DOCUMENTS

| | | | | |
|---|---|---|---|---|
| 7,631,400 | B2 * | 12/2009 | Chiang | 24/170 |
| 8,042,199 | B2 * | 10/2011 | Chiang | 2/448 |
| 8,122,521 | B2 * | 2/2012 | Chiang | 2/428 |
| 8,132,271 | B2 * | 3/2012 | Chiang | 2/444 |
| 8,225,430 | B2 * | 7/2012 | Chiang | 2/448 |
| 8,230,528 | B2 * | 7/2012 | Chiang | 2/448 |
| 2009/0205114 | A1 * | 8/2009 | Chiang | 2/428 |

* cited by examiner

*Primary Examiner* — Khoa Huynh
*Assistant Examiner* — Andrew W Collins
(74) *Attorney, Agent, or Firm* — Cheng-Ju Chiang

(57) ABSTRACT

Swimming goggles includes a frame body, lenses, buckles disposed at opposite end portions of the frame body, and a head strap passed through the buckles. The frame body forms shielding portions at outer sides of the frame body. The buckles have bases and operating devices being shielded by the shielding portions. The operating devices are operated through the shielding portions so as to adjust the head strap and prevent a wearer's hair from being snapped and provide a comfort wearing.

9 Claims, 10 Drawing Sheets

SWIMMING GOGGLES

BACKGROUND OF THE INVENTION

1. Field of the Invention

The present invention relates to swimming goggles, and particularly to swimming goggles having buckles operated by pressing upper and lower portions thereof to quickly and easily adjust the length of a head strap without snapping a wearer's hair.

2. Related Art

In general, swimming goggles are provided with buckles disposed on left and right sides of frames for connecting a head strap, which is allowed to be adjustable in length through the buckles. Each of the buckles includes an engaging arm for engaging serrated grooves of the head strap. When the engaging arm engages the head strap, the head strap merely can be tightened in a single direction. To loosen the head strap, the engaging arm has to be disengaged with the serrated groove. As a result, adjustment of the head strap is directly associated with engagement of the engaging arm and the serrated groove.

Traditional buckles, which controls engagement of the engaging arm, is commonly designed based on a first lever principle, that is, to exert pressing force on one end of the engaging arm, while the opposite end of the engaging arm moves in a reverse direction to release the engaging arm. Furthermore, a resilient element is provided on the end of the engaging arm where pressing force applied thereon for returning the engaging arm.

However, pressing elements used to press the engaging arms of traditional buckles are disposed at a side of the buckles directly contacting a wearer's head and therefore are easily to snap the wearer's hair. Furthermore, a traditional engaging arm must operate with an additional element, the resilient element, to help the engaging arm return to a previous state. Consequently, traditional buckles have complex structure which leads to a high manufacturing cost and are difficult for assembly.

SUMMARY OF THE INVENTION

Accordingly, an object of the present invention is to provide swimming goggles having buckles being shielded so as to prevent a wearer's hair from being snapped and to provide a comfort wearing.

Another object of the present invention is to provide swimming goggles having buckles of simple structure and easily to be assembled, the buckles having operating devices formed in one entity and intended to conveniently engage and disengage a head strap.

To achieve the above-mentioned objects, swimming goggles of the present invention comprise a frame body having left and right frames, a nose bridge interconnecting the left and right frames, and padding portions attached to the left and right frames, respectively, wherein the left and right frames form shielding portions at outer sides of the left and right frames, respectively; lenses assembled with the frame body; buckles disposed at opposite end portions of the frame body and partially shielded by the shielding portions, respectively. Each of the buckles comprises a base provided with a pivot portion, and an operating device assembled with the base and shielded by the shielding portion. A head strap has two opposite free end portions passed through the pivot portions, respectively. Each free end portion of the head strap forms a plurality of serrated grooves for being engaged with the operating device.

In accordance with the present invention, the shielding potion integrally forms oval humps with respect to the operating portions of the second arm for facilitating manually operation.

In accordance with the present invention, each of the bases comprises connectable first and second casings, the first casing has a hollow portion therein, the pivot portion including a shaft and pivot holes. The operating device comprises a first arm and a second arm, the first and second arms cooperatively forming a substantially T shape such that one end of the first arm integrally connected to a middle portion of the second arm, and another end of the first arm is formed with an engaging portion, the second arm has an arc shape, and operating portions are formed on opposite ends of the second arm and located in alignment with each other. With the above-mentioned structure, when the operating portions are being pressed concurrently, the first arm moves in conjunction with the second arm so as to allow the engaging portion to move to engage and disengage the head strap.

DESCRIPTION OF THE PREFERRED EMBODIMENTS

Figure 1:
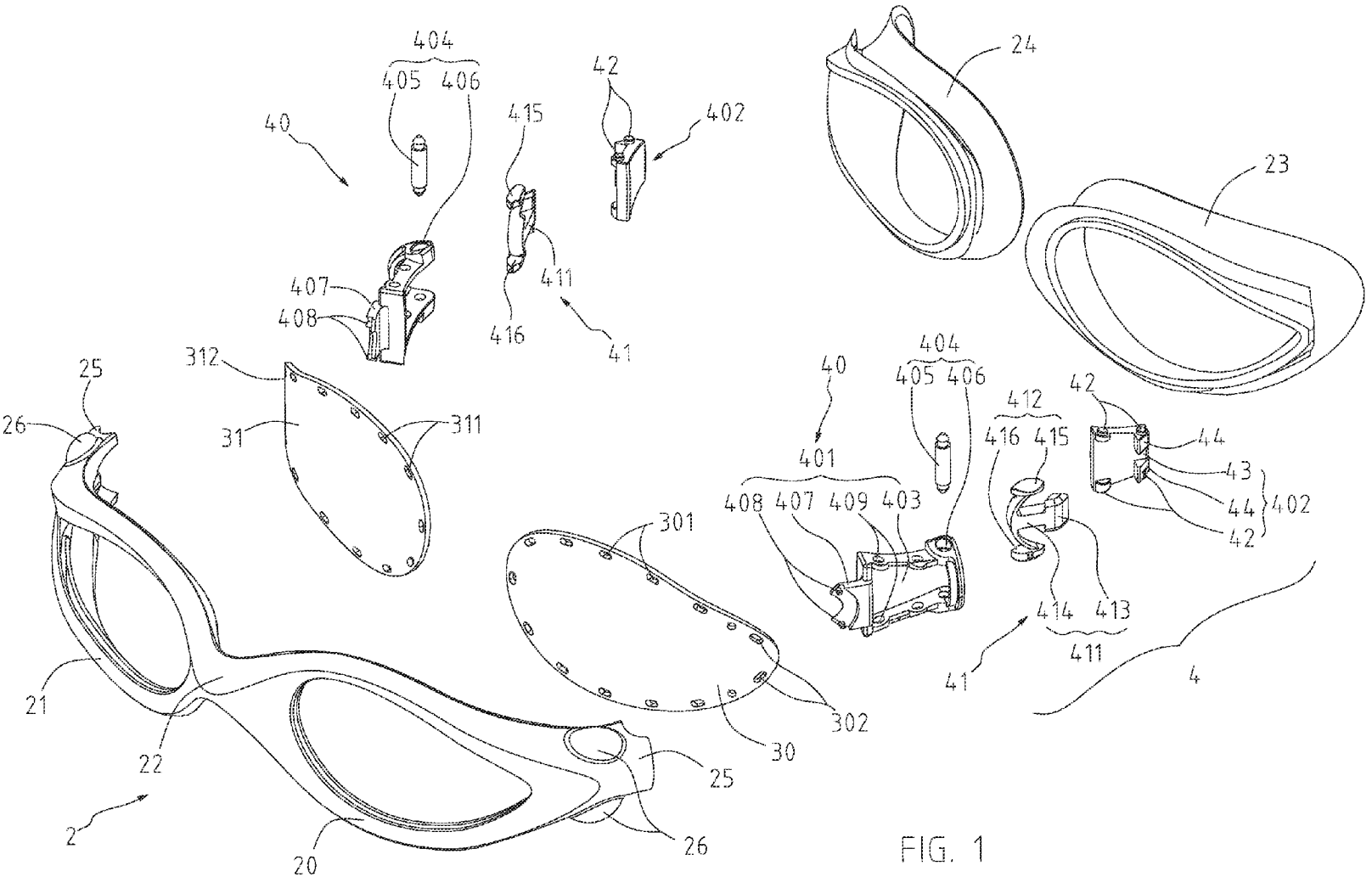
FIG. 1 is an exploded perspective view of swimming goggles of the present invention.
Figure 2:
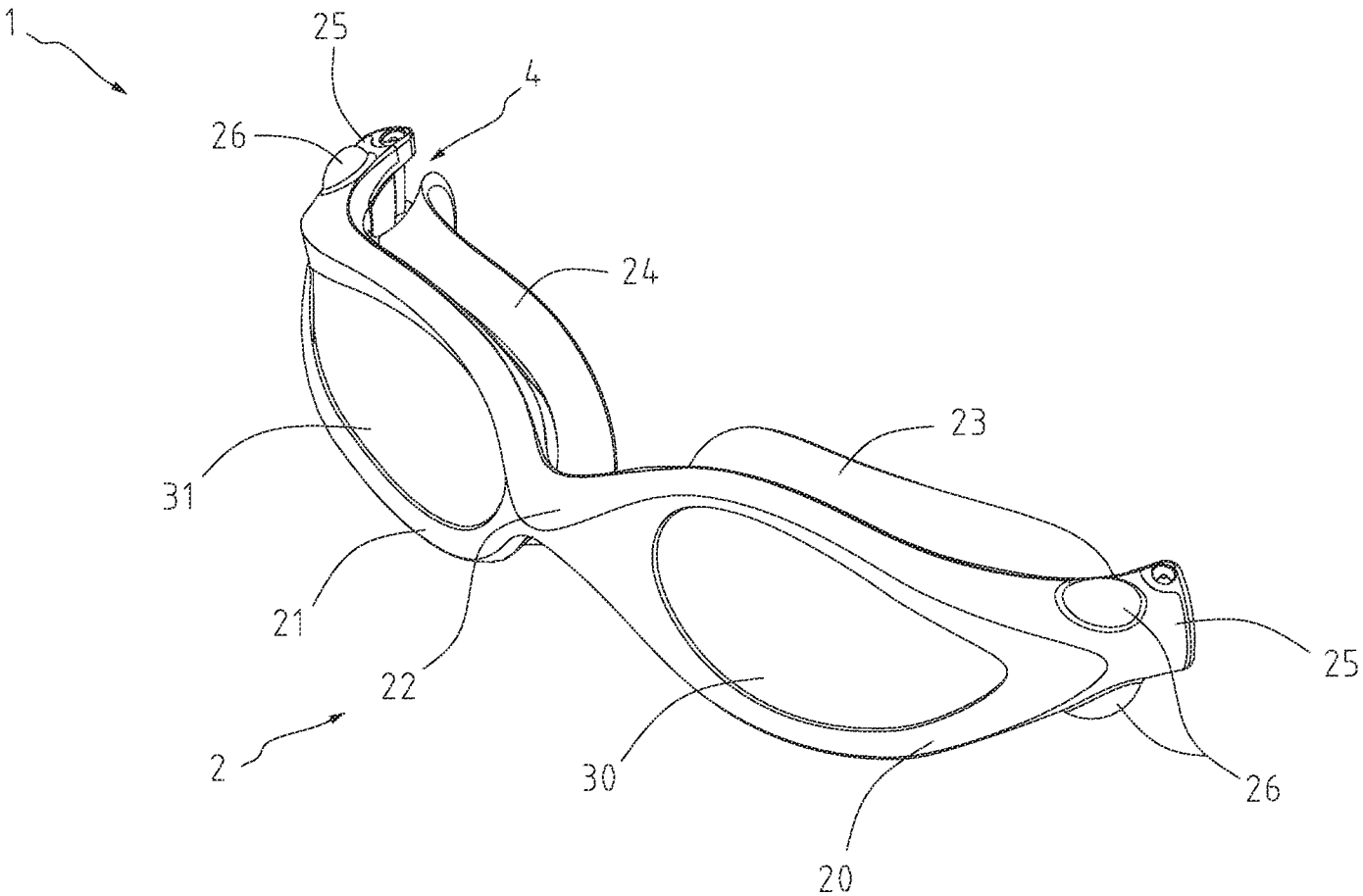
FIG. 2 is a perspective assembly view of FIG. 1.
Figure 3:
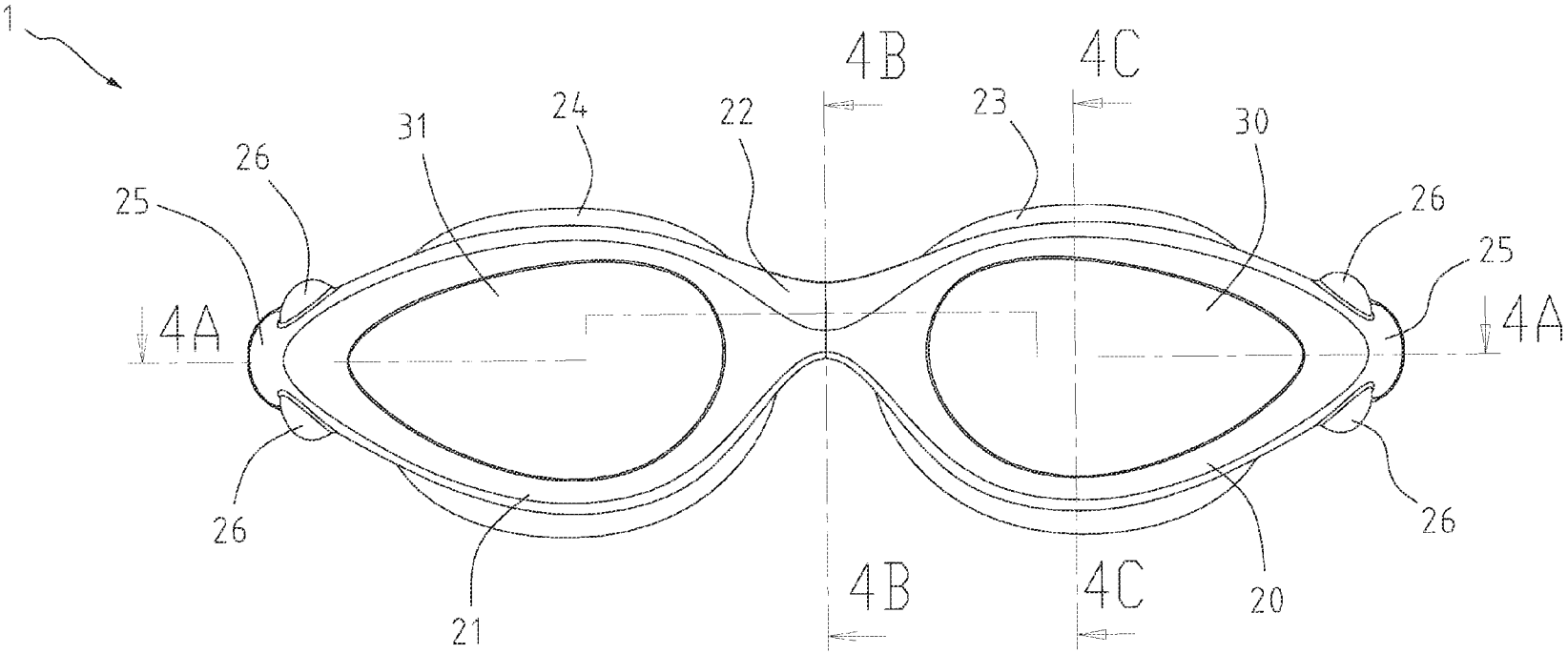
FIGS. 3 and 5 are front elevational views of the swimming goggles.
Figure 4A:
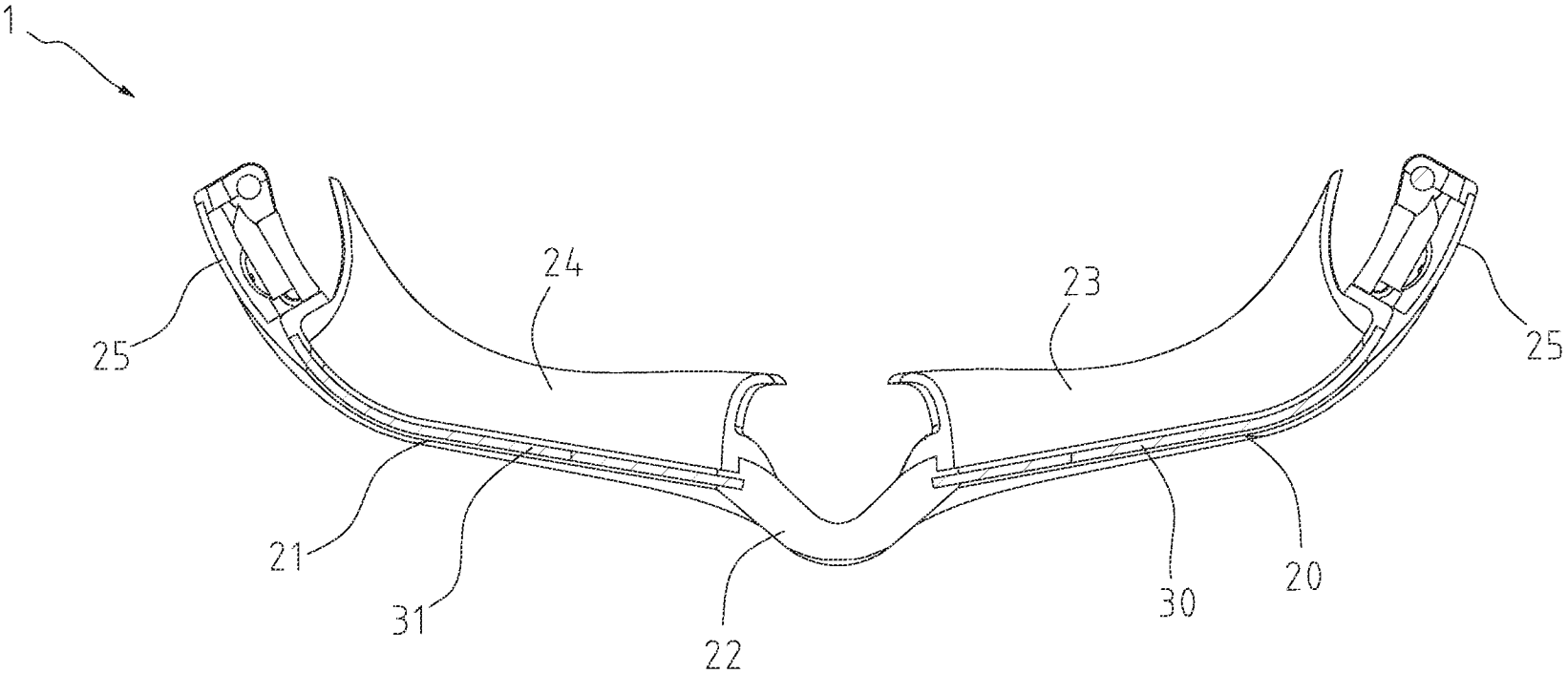
FIGS. 4A to 4C are cross-sectional views taken along the lines 4A-4A, 4B-4B, 4C-4C in FIG. 3, respectively.
Figure 4C:
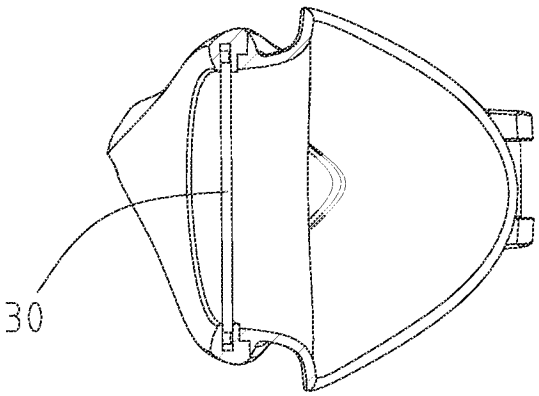
Figure 4B:
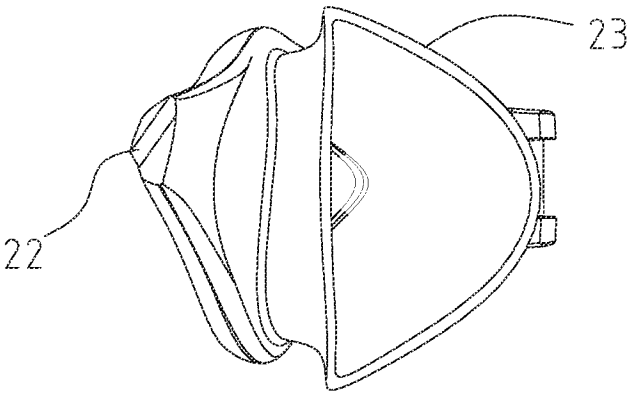
Figure 5:
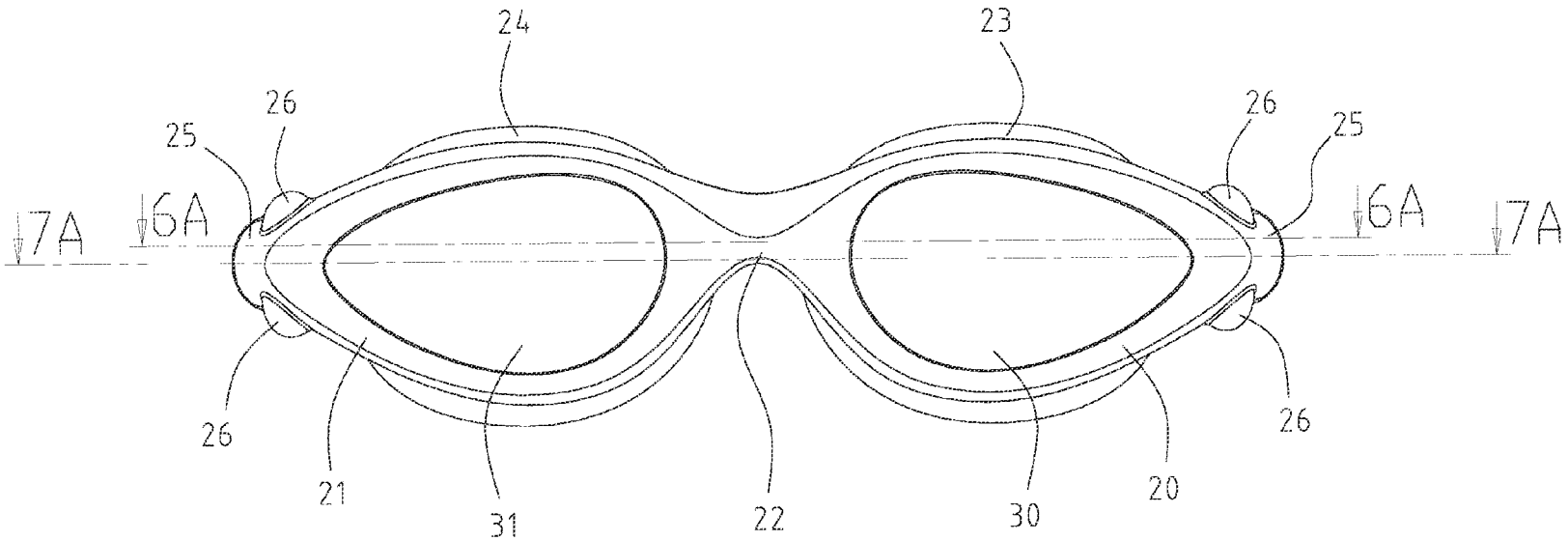
Figures 6, 6A:
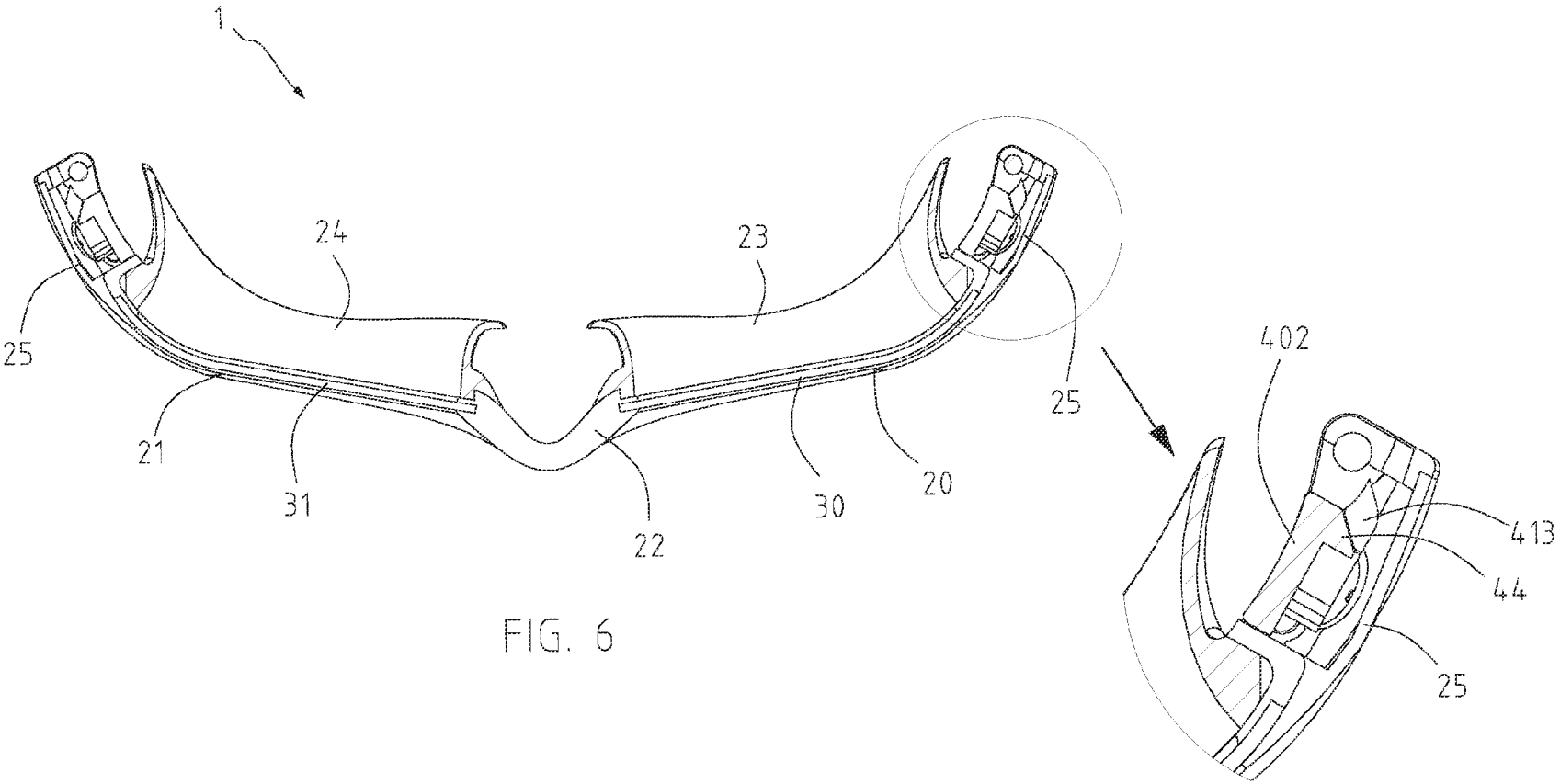
FIGS. 6 and 6A are a cross-sectional view taken along the line 6A-6A in FIG. 5 and partially enlarged view thereof.
Figures 7, 7A:
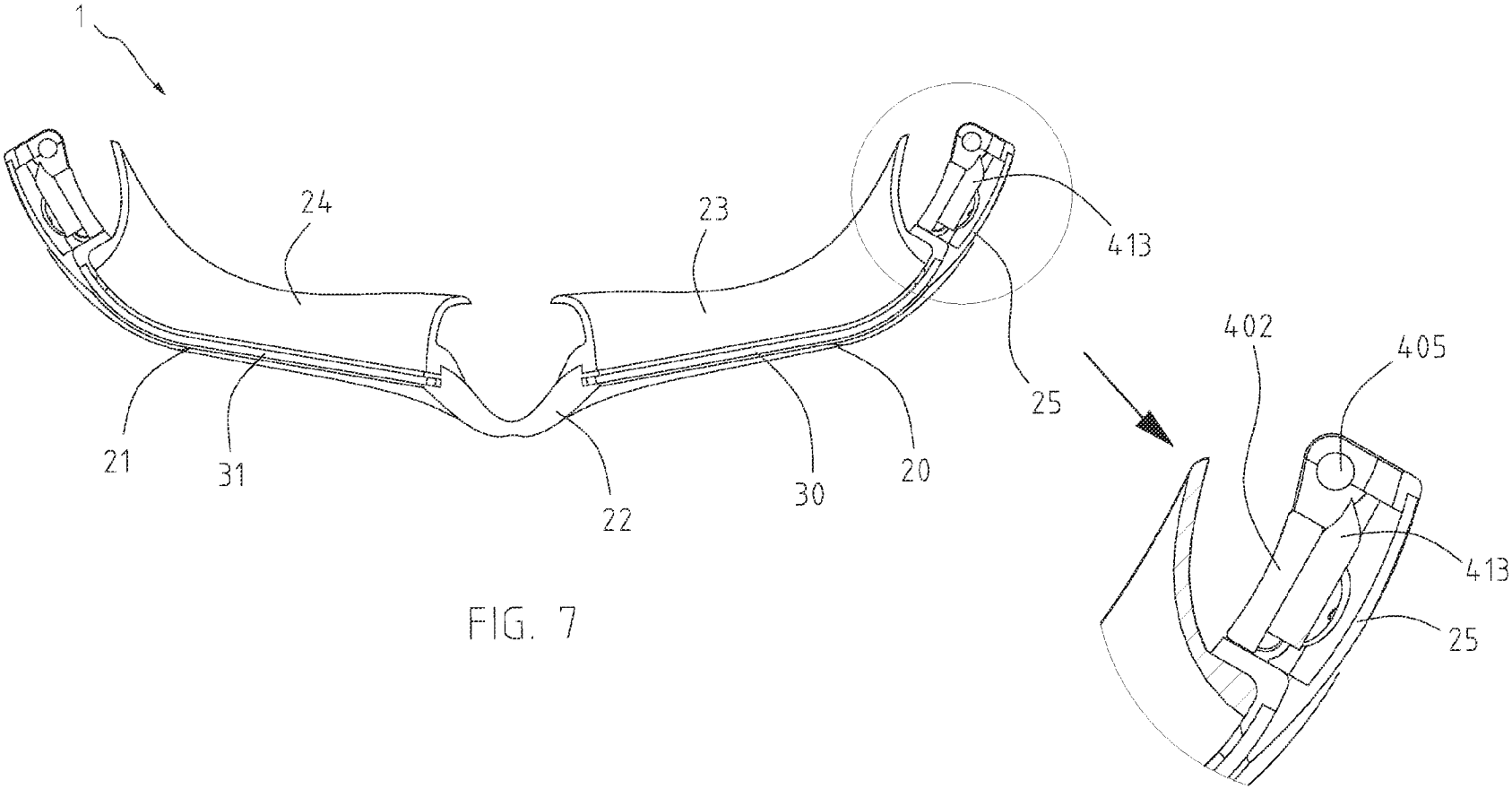
FIGS. 7 and 7A are a cross-sectional view taken along the line 7A-7A in FIG. 5 and partially enlarged view thereof.
Figure 9:
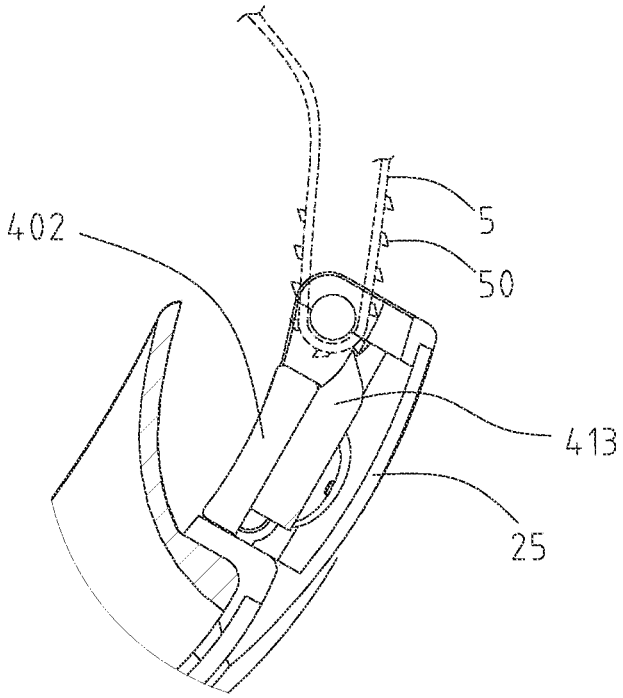
FIG. 9 is a schematic view showing a state of adjusting a head strap by pressing upper and lower portions of the operating device.

Referring to FIGS. 1 to 4C, swimming goggles 1 of the present invention comprises: a frame body 2, lenses 30, 31, buckles 4 disposed at opposite end portions of the frame body 2, and a head strap 5 passed through the buckles 4 (as shown in FIG. 9, the head strap 5 forms a plurality of serrated grooves 50). The frame body 2 has left and right frames 20, 21, a nose bridge 22 interconnecting the left and right frames 20, 21, and padding portions 23, 24 attached to the left and right frames 20, 21, respectively, wherein the first and second frame 20, 21, the nose bridge 22, and the padding portions 23, 24 are integrally formed and made of Thermal Plastic Rubber (TPR), and the padding portions 23, 24 are thinner than the left and right frames 20, 21 for providing a soft contact when wearing. Furthermore, shielding portions 25 are integrally formed on outer sides of the left and right frames 20, 21, respectively, and are intended to shield and hide the buckles 4 behind the shielding portions 25 (as shown in FIG. 2). Each of the shielding portions 25 integrally forms oval humps 26 protruding outwardly of upper and lower portions of the shielding portion 25, respectively. The oval humps 26 are intended for facilitating manually operation.

Peripheral portions of the lenses 30, 31 are formed with a plurality of injection holes 301, 311 and two connecting holes 302, 312, respectively. The two connecting holes 302, 312 are disposed on portions of the lenses 30, 31 far away from the nose bridge 22, for being connected with the buckles 4 and providing a preliminary position of the buckles 4.

Referring to FIG. 1 in combination with the FIGS. 5 to 8 and 8A, the buckles 4 are made of polycarbonate (PC), nylon resin, or thermoplastic polyurethane. Each buckle 4 comprises a base 40 and an operating device 41, wherein the base 40 comprises first and second casings 401, 402 connectable with each other. The first casing 401 has a hollow portion 403 formed therein and a pivot portion 404 formed at a side of the first casing 401. The pivot portion 404 consists of a shaft 405 and pivot holes 406 for receiving opposite ends of the shaft 405, and the pivot portion 404 is configured to allow the head strap 5 to pass therethrough. Furthermore, a connecting arm 407 extends laterally from the first casing 401 towards the lenses 30, 31, and is provided with two pegs 408 corresponding to and inserted in the connecting holes 302, 312 of the lenses 30, 31 in order for preliminarily positioning the first casings 401 on the lenses 30, 31. The first casing 401 forms multiple assembling holes 409 at upper and lower sides thereof. The second casing 402 is disposed at a side of the hollow portion 403 and intended to operate with the operating device 41. The second casing 402 is provided with multiple pillars 42 protruding outwards of upper and lower sides of the second casing 402 so as to be inserted in the assembling holes 409 and to connect the first and second casings 401, 402. Particularly, the second casing 402 has two guiding elements 44 spaced apart from each other, and a positioning slot 43 formed between the two guiding elements 44.

Each of the operating devices 41 comprises a first arm 411 and a second arm 412, the first and second arms 411, 412 cooperatively forming a substantially T shape such that one end 414 of the first arm 411 integrally connected to a middle portion of the second arm 412, and another end of the first arm 411 is formed with an engaging portion 413 which extends outwardly from opposite sides of the first arm 411. The first arm 411 is movably disposed in the positioning slot 43 with the engaging portion 413 engaged with the two guiding elements 44 in such a way that the engaging portion 413 is capable of moving along surfaces of the two guiding elements 44 in conjunction with the first arm 411 to disengage the serrated grooves 50 of the head strap 5 (as shown in FIG. 9). The second arm 412 has an arc shape and operating portions 415, 416 formed on opposite ends of the second arm 412. The operating portions 415, 416 are located in alignment with each other in a same axial direction, and each of the operating portions 415, 416 has a shape corresponding to the oval hump 26 so as to completely fit to the oval hump 26.

Figure 8A:
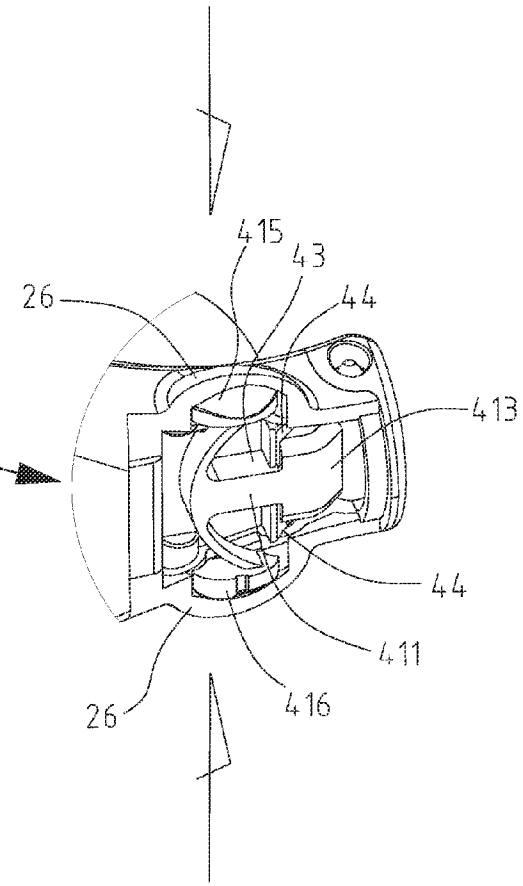
FIG. 8A is a partially enlarged view of FIG. 8.
Figure 8:
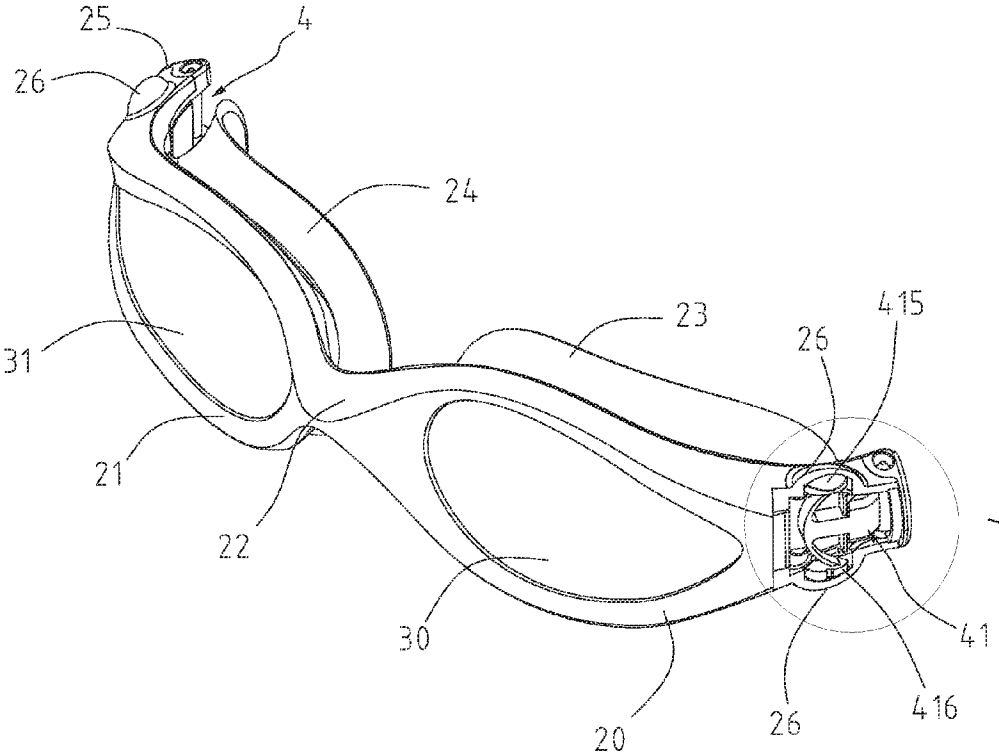
FIG. 8 is FIG. 2 with a shielding portion being removed to schematically show an operating device.

Referring to FIG. 1 in combination with FIG. 2 and FIG. 8A, the present invention in assembly, firstly, the first and second casings 401, 402 are connected with the assembling holes 409 and the pillars 42. Then, the operating device 41 of the buckle 4 is disposed inside the shielding portion 25 where the operating portions 415, 416 perfectly fit in the oval humps 26 and are exposed outside of the first casing 401, and the engaging portions 413 of the first arm 411 engage with the two guiding elements 44 and expose to the positioning slot 43 (as shown in FIG. 8A). Next, the pegs 408 of the connecting arm 407 are inserted in the connecting holes 302, 312 of the lenses 30, 31. Finally, through the injection molding technique the left and right frames 20, 21, the nose bridge 22, the padding portions 23, 24, the connecting arms 407, and the injection holes 301, 311 and the connecting holes 302, 312 of the lenses 30, 31 are all formed integrally.

Referring to FIG. 2, because the buckles 4 are disposed in and shielded by the shielding portions 25, the buckles 4 are not likely to contact a wearer's head and snap the wearer's hair. Referring to FIG. 8A and FIG. 9, to adjust the head strap 5, it is only needed to press the oval humps 26 concurrently (as indicated by the arrows) to further press the operating portions 415, 416, whereby the second arm 412 deforms accordingly and bends towards the connecting arm 407. As a result, the first arm 411 moves in conjunction with the second arm 412, and the engaging portion 413 moves along the surfaces of the two guiding elements 44 towards the connecting arm 407 so as to disengage the serrated grooves 50 of the head strap 5, whereby the head strap 5 is allowed to move through the pivot portion 404. Likewise, when the oval humps 26 are not being pressed, the second arm 412 returns to a previous state of not bending, and the engaging portion 413 moves back along the surfaces of the two guiding elements 44 to engage the serrated grooves 50.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising:

a frame body having left and right frames, a nose bridge interconnecting the left and right frames, and padding portions attached to the left and right frames, respectively, wherein the left and right frames form shielding portions at outer sides of the left and right frames, respectively;

lenses assembled with the frame body;

buckles disposed at opposite end portions of the frame body and partially shielded by the shielding portions, respectively, each of the buckles comprising a base provided with a pivot portion, and an operating device assembled with the base and shielded by the shielding portion; and a head strap having two opposite free end portions passed through the pivot portions, respectively, each free end portion of the head strap forming a plurality of serrated grooves for being engaged with the operating device;

wherein the operating device comprises a first arm and a second arm, the first and second arms cooperatively forming a substantially T shape such that one end of the first arm integrally connected to a middle portion of the second arm, and another end of the first arm is formed with an engaging portion;

wherein each of the bases comprises connectable first and second casings, wherein the second casing has two guiding elements spaced apart from each other, and a positioning slot formed between the two guiding elements, wherein the first arm is movably disposed in the positioning slot with the engaging portion engaged with the two guiding elements in such a way that the engaging portion is capable of moving along surfaces of the two guiding elements in conjunction with the first arm to disengage and engage the serrated grooves.

2. The swimming goggles of claim 1, wherein the second arm has an arc shape, and operating portions are formed on opposite ends of the second arm and located in alignment with each other.

3. The swimming goggles of claim 2, wherein the shielding portion integrally forms oval humps with respect to the operating portions of the second arm.

4. The swimming goggles of claim 3, wherein the engaging portion of the first arm extends outwardly from opposite sides of the first arm, and each of the operating portions has a shape corresponding to the oval hump.

5. The swimming goggles of claim 4, wherein the left and right frames, padding portions, and the nose bridge are integrally formed, and the padding portions are thinner than the left and right frames for providing a soft contact when wearing.

6. The swimming goggles of claim 5, wherein the bases of the buckles are connected with the lenses, respectively.

7. The swimming goggles of claim 6, wherein peripheral portions of each of the lenses are formed with a plurality of injection holes and at least a connecting hole, the at least a connecting hole being connected with the base.

8. The swimming goggles of claim 7, wherein the first casing has a hollow portion therein, the pivot portion including a shaft and pivot holes, and a connecting arm having at least a peg corresponding to the connecting hole of the lens, and the second casing is disposed at a side of the hollow portion and intended to operate with the operating device.

9. The swimming goggles of claim 8, wherein the first casing forms multiple assembling holes, the second casing is provided with multiple pillars corresponding to and connected to the assembling holes.

* * * * *